United States Patent [19]

Chu et al.

[11] 4,442,437

[45] Apr. 10, 1984

[54] SMALL DUAL FREQUENCY BAND, DUAL-MODE FEEDHORN

[75] Inventors: Ta-Shing Chu, Lincroft; Robert W. England, Piscataway, both of N.J.

[73] Assignee: Bell Telephone Laboratories, Incorporated, Murray Hill, N.J.

[21] Appl. No.: 342,058

[22] Filed: Jan. 25, 1982

[51] Int. Cl.[3] ..... H01Q 13/06

[52] U.S. Cl. ..... 343/786

[58] Field of Search ..... 343/786, 776, 772, 778, 343/773

[56] References Cited

U.S. PATENT DOCUMENTS

| | | | |
|---|---|---|---|
| 3,305,870 | 2/1967 | Webb | 343/786 |
| 3,413,641 | 11/1968 | Turrin | 343/786 |
| 3,482,252 | 12/1969 | Nagelburg | 343/786 |
| 3,510,875 | 5/1970 | Beguin | 343/786 |
| 3,605,101 | 9/1971 | Kolettis et al. | 343/783 |
| 3,662,393 | 5/1972 | Cohn | 343/786 |
| 3,680,145 | 7/1972 | Beguin | 343/786 |
| 3,696,434 | 10/1972 | Sciambi, Jr. | 343/776 |
| 4,122,446 | 10/1978 | Hansen | 343/786 |
| 4,141,015 | 2/1979 | Wong et al. | 343/786 |
| 4,168,504 | 9/1979 | Davis | 343/786 |
| 4,295,142 | 10/1981 | Thiere et al. | 343/781 |

OTHER PUBLICATIONS

Ri-rong et al., "The New Multimode Horn Composed of a Corrugated Guide and a Smooth-Walled Guide with Changing Flare Angles", Radio Science, vol. 15, No. 1, Jan.-Feb., 1980, pp. 135-141.

Nagelburg, "Phase Progression in Conical Waveguides", BSTJ, vol. 46, No. 10, 12/67, pp. 2453-2466.

Cohn, "Flare-Angle Changes in a Horn as a Means of Pattern Control", Microwave Journal, vol. 13, No. 10, 10/70, pp. 41-46.

Sato, "Dielectric Loaded Horn Antenna", E & C in Japan, vol. 54-B, No. 9, 9/79, pp. 57-63.

Ebisui et al., "A Circularly Polarized Flare Iris Type Dual-Mode Horn Antenna", IECE of Japan, vol. E62, No. 12, 12/79, pp. 904-905.

Potter, "A New Horn Antenna with Suppressed Sidelobes and Equal Beamwidths", Microwave Journal, vol. 6, No. 6, Jun. 1963, pp. 71-78.

Nagelburg et al., "Mode Conversion in Circular Waveguide", BSTJ, vol. XLIV, No. 7, Sep. 1965, pp. 1321-1338.

Turrin, "Dual Mode Small-Aperture Antennas", IEEE Trans. on Antennas and Prop., vol. AP-15, Mar. 1967, pp. 307-308.

Han et al., "A New Multimode Rectangular Horn Antenna Generating a Circularly Polarized Elliptical Beam", IEEE Trans. on Antennas and Prop., vol. AP-22, No. 6, 11/74.

*Primary Examiner*—Eli Lieberman
*Assistant Examiner*—Michael C. Wimer
*Attorney, Agent, or Firm*—Erwin W. Pfeifle

[57] ABSTRACT

The present invention relates to a dual frequency band, dual-mode feedhorn comprising three serially connected waveguide sections (20, 22, 24) and a separate discontinuity (21, 23) at each joint between waveguide sections. More particularly, the feedhorn comprises a first waveguide section (20) for supporting the $TE_{11}$ mode in both frequency bands. A first discontinuity (21) symmetrically increases the first waveguide size for converting a portion of the $TE_{11}$ mode in both frequency bands into the $TM_{11}$ mode. The second waveguide section (22) connected to the first discontinuity comprises an aperture size for supporting the $TE_{11}$ mode in both frequency bands but only the $TM_{11}$ mode of the higher frequency band. A second discontinuity (23) symmetrically increases the size of the second waveguide for converting another portion of the $TE_{11}$ mode in both frequency bands into the $TM_{11}$ mode. A third waveguide section (24) coupled to the second discontinuity is capable of propagating both modes in both frequency bands with a length to cause the vector sums of each of the remaining $TE_{11}$ and $TM_{11}$ modes in each frequency band to be in phase at the exit port of the feedhorn.

4 Claims, 6 Drawing Figures

SMALL DUAL FREQUENCY BAND, DUAL-MODE FEEDHORN

BACKGROUND OF THE INVENTION

1. Field of the Invention

The present invention relates to a small dual frequency band, dual-mode, feedhorn and, more particularly, to a small feedhorn comprising in sequence a first waveguide section capable of supporting a dominant $TE_{11}$ mode in two separate frequency bands, a first discontinuity for converting a portion of the $TE_{11}$ mode in each frequency band into the $TM_{11}$ mode, a second waveguide section for propagating the $TE_{11}$ mode in both frequency bands and only the $TM_{11}$ mode in the higher frequency band, a second discontinuity for converting a portion of the $TE_{11}$ mode in both frequency bands into the $TM_{11}$ mode, and a third waveguide section comprising a length such that the $TE_{11}$ mode energy and the vector sum of associated $TM_{11}$ mode energies in both frequency bands are in phase at the exit port of the feedhorn.

2. Description of the Prior Art

Horn antennas as well as devices and techniques for exciting higher order modes in horns for improved performance are well known in the art. One such technique is to introduce one or more abrupt symmetrical steps within the guide as shown, for example, in U.S. Pat. Nos. 3,305,870 issued to J. E. Webb on Feb. 21, 1967; 3,510,875 issued to D. E. Beguin on May 5, 1970; and 4,122,446 issued to L. H. Hansen et al on Oct. 24, 1978. Alternative techniques to the abrupt step is the use of a groove or iris within the guide as shown, for example, in the article "A New Horn Antenna With Suppressed Sidelobes and Equal Beamwidth" by P. D. Potter in *The Microwave Journal,* Vol. VI, No. 6, June 1963 and "Mode Conversion in Circular Waveguides" by E. R. Nagelberg et al in BSTJ, Vol. XLIV, No. 7, September 1965 at pages 1321–1338.

Still another technique for mode conversion is to use a circular dielectric rod having tapered ends mounted coaxially within a conical horn as shown, for example, in U.S. Pat. No. 3,605,101 issued to N. J. Kolettis et al on Sept. 14, 1971. An alternative configuration using dielectrics for mode conversion uses dual dielectric bands mounted within a flared guide as shown in U.S. Pat. No. 4,141,015 issued to M. N. Wong et al on Feb. 20, 1979 for improving the rotational symmetry or ellipticity of the radiated beam. Still another dielectrically loaded horn antenna for dual-band use is shown in the article "Dielectric-Loaded Horn Antenna" by T. Sato in *Electronics and Communications in Japan,* Vol. 54-B, No. 9, September 1971 at pages 57–63 where dielectric strips are mounted within the horn. However, such dielectric belts or strips must be accurately positioned on the tapered section of the horn to obtain the proper effect, and such placement is critical.

The problem remaining in the prior art is to provide a dual frequency band, dual-mode horn which is easily achieved by the use of less critical techniques than found with the prior art arrangements and which will operate over two narrow bands separated by about 20 percent.

SUMMARY OF THE INVENTION

The foregoing problem has been solved in accordance with the present invention which relates to a small dual frequency band, dual-mode, feedhorn and, more particularly, to a small feedhorn comprising in sequence a first waveguide section capable of supporting a dominant $TE_{11}$ mode in two separate frequency bands, a first discontinuity for converting a portion of the $TE_{11}$ mode in each frequency band into the $TM_{11}$ mode, a second waveguide section for propagating the $TE_{11}$ mode in both frequency bands and only the $TM_{11}$ mode in the higher frequency band, a second discontinuity for converting a portion of the $TE_{11}$ mode in both frequency bands into the $TM_{11}$ mode, and a third waveguide section comprising a length such that the $TE_{11}$ mode energy and the vector sum of associated $TM_{11}$ mode energies in both frequency bands are in phase at the exit port of the feedhorn.

Other and further aspects of the present invention will become apparent during the course of the following description and by reference to the accompanying drawings.

BRIEF DESCRIPTION OF THE DRAWINGS

Referring now to the drawings, in which like numerals represent like parts in the several views.

DETAILED DESCRIPTION

Figure 1:
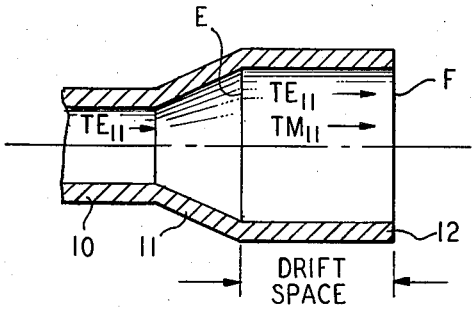
FIG. 1 (PRIOR ART)
FIG. 1 illustrates a view in cross-section of a prior art dual-mode feedhorn.
Figure 2:
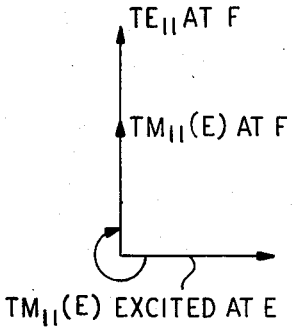
FIG. 2 (PRIOR ART)
FIG. 2 illustrates a vector diagram of the modes of the feedhorn of FIG. 1.

As described in the article "Flare-Angle Changes In A Horn As A Means of Pattern Control" by S. B. Cohn in *Microwave Journal,* Vol. 13, No. 10, October 1970 at pages 41–46, the bandwidth of a typical prior art dual-mode, single frequency band, feedhorn, as shown in present FIG. 1, is limited by the required 270 degree differential phase shift between the $TE_{11}$ and $TM_{11}$ modes in the drift space. More particularly, the feedhorn of FIG. 1 comprises a cylindrical waveguide section 10 which is capable of propagating the $TE_{11}$ mode at the frequency band of interest. A symmetrical mode conversion section 11, which expands the horn at the exit port of waveguide 10, functions to convert a portion of the $TE_{11}$ mode into the $TM_{11}$ mode at area E where the $TM_{11}$ mode is 270 degrees out of phase with the $TE_{11}$ mode, as shown in FIG. 2. The exit port of the mode conversion section joins a cylindrical waveguide section 12 which forms the drift space and has a length to permit the $TE_{11}$ and $TM_{11}$ modes to be in phase at the aperture F of the feedhorn, as shown in FIG. 2.

Figure 3:
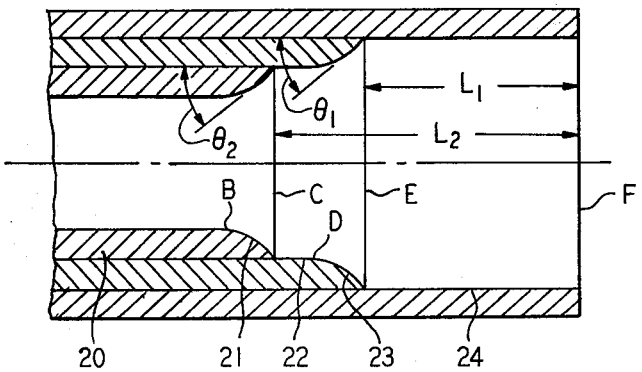
FIG. 3 illustrates a view in cross-section of a small dual frequency band, dual-mode, feedhorn in accordance with the present invention.

FIG. 3 shows a feedhorn in accordance with the present invention which provides two separate narrow frequency bands spaced apart by a moderate frequency ratio as would be required in, for example, a satellite communication system. In the feedhorn of FIG. 3, a cylindrical waveguide section 20 comprises an aperture dimension which will propagate only the $TE_{11}$ mode with the $TM_{11}$ mode being cut off in both the upper and lower frequency bands of interest. The aperture dimension of a second waveguide section 22 between areas C and D is such as to accommodate both the $TE_{11}$ and $TM_{11}$ modes in the higher frequency band ($f_2$) of interest but only the $TE_{11}$ mode in the lower frequency band ($f_1$) of interest. The aperture dimension of a third cylindrical waveguide section 24 between areas E and F is such as to accommodate the $TE_{11}$ and $TM_{11}$ modes in both frequency bands of interest.

Aperture expanding sections 21 and 23 form mode conversion sections which, in the vicinities of areas B and D comprise smooth rounded corners which avoid the unwanted excitation of the $TM_{11}$ modes. The discontinuities at areas C and E at the mode conversion sections excite proper amounts of the $TM_{11}$ mode via the field curvature which is determined by the slant angles $\theta_2$ and $\theta_1$, respectively. In the lower frequency band of interest ($f_1$), the feedhorn of FIG. 3, in sections 23 and 24, will behave similar to the conventional dual-mode feedhorn of FIG. 1, i.e., the $TM_{11}$ mode will be excited and propagate only from the point E with a relative phase of about 90 degrees with respect to the $TE_{11}$ mode, and then undergo a 270 degree differential phase shift in section 24 between points E and F, as shown in the vector diagram of FIG. 4. The $TM_{11}$ mode excited at C will be suppressed between C and D by cylindrical waveguide section 22, if made sufficiently long.

Figure 4:
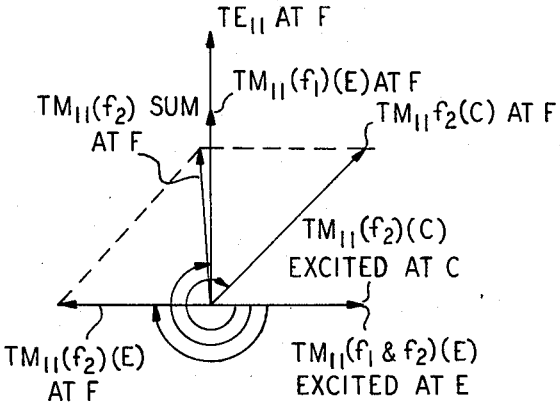
FIG. 4 illustrates a vector diagram of the modes of the feedhorn of FIG. 3 for the higher and lower frequency bands of interest.

As also shown in the vector diagram of FIG. 4, in the higher frequency band of interest ($f_2$), the $TM_{11}$ mode will be excited and then propagate from both points C and E. If the amplitudes and phases of the two $TM_{11}$ mode components at the higher frequency band of interest ($f_2$) are adjusted as shown in FIG. 4, then a good circular symmetrical dual-mode pattern will be also obtained at the higher frequency band at the aperture of the feedhorn. It must be understood that although both a $TM_{11}$ mode in the higher and the lower frequency band is excited at point E, the drift space is such that the $TM_{11}$ mode of the lower frequency band undergoes a 270 degree differential phase shift while the $TM_{11}$ mode of the higher frequency band undergoes a lesser differential phase shift since it is well known that a lower frequency encounters a greater differential phase shift than a higher frequency over a predetermined drift space.

From the hereinbefore discussion, it becomes clear that the distances $L_1$ (between points E and F) and $L_2$ (between points C and F) as shown in FIG. 3 are most important, and that the angles $\theta_1$ and $\theta_2$ are next important in achieving a circularly symmetrical dual frequency band, dual-mode pattern at the aperture F. Typical angles for $\theta_1$ and $\theta_2$ and $\theta_1=20$ degrees and $\theta_2=30$ degrees for adequate mode conversions in the usual design of a small dual-mode tapered-step feedhorn similar to the arrangement shown in FIG. 1. Such values for $\theta_1$ and $\theta_2$, however, are merely presented for purposes of exposition and not for purposes of limitation since angles between 20 degrees and 50 degrees are preferred, although not absolute in value, since such range of angle values has proven to provide very good results. It must be understood that the larger angles introduce a greater amount of the $TM_{11}$ mode in the higher frequency band and it may be found that the E-plane patterns are slightly wider than the H-plane patterns.

Although for the arrangement of FIG. 3, the $L_1$ and $L_2$ dimensions can be calculated to provide the resultant vector diagram of FIG. 4, the arrangement of FIG. 3 is provided to illustrate both the concept of the present invention and how an experimental model can be made. In the arrangement shown in FIG. 3, three circular cylinders 20, 22 and 24, formed of a conductive material such as brass, are mounted one inside the other such that the outer wall of cylinder 20 slidably engages the inner wall of cylinder 22 and the outer wall of cylinder 22 slidably engages the inner wall of cylinder 24. In this manner the cylinders can slide with respect to each other to facilitate phase adjustment for achieving the aforementioned mode combinations shown in FIG. 4.

Once properly adjusted by first slidably adjusting cylinder 22 with respect to cylinder 24 for achieving the appropriate drift space for the 270 degree differential phase shift for the $TM_{11}$ mode at the lower frequency band, the cylinder 20 can then be slidably adjusted for achieving a properly phased $TM_{11}$ sum for the higher frequency band at the aperture F of the feedhorn. Once properly adjusted, the cylinders can be fixedly secured to each other by, for example, set screws (not shown) and the design measurements taken. Regardless of the technique used for achieving the appropriate dimensions of the present feedhorn, the proper inner aperture surface configuration can be produced by any suitable technique as, for example, by machining or electroforming the desired internal shape.

Figure 5:
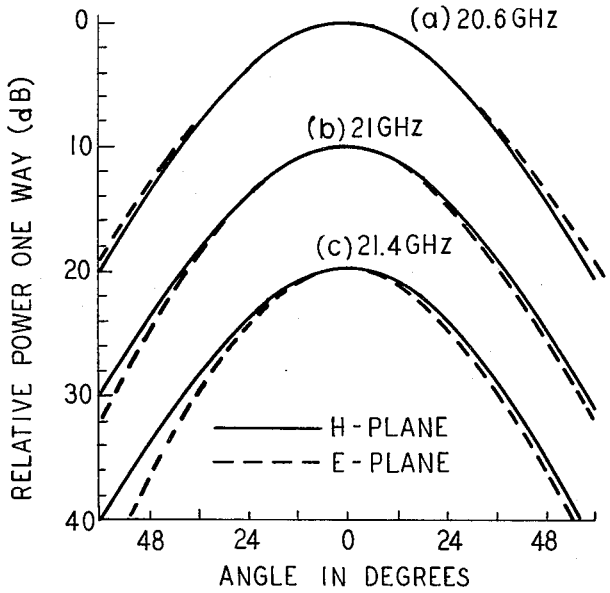
FIG. 5 is a curve of the measured patterns of a particular feedhorn of FIG. 3 in a lower frequency band.
Figure 6:
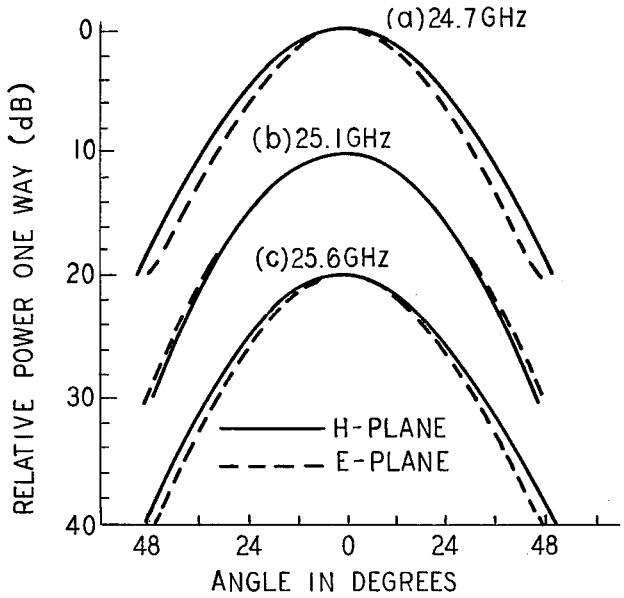
FIG. 6 is a curve of the measured patterns of the same feedhorn that produced the curve of FIG. 5 but in the higher frequency band.

It is relatively easy to achieve circular pattern symmetry at two fixed frequencies with, for example, a ratio of 1.2:1. However, the feedhorn of the present invention must operate over two small bands of frequencies. FIGS. 5 and 6 illustrate exemplary patterns of a feedhorn of FIG. 3 having lower and higher frequency bands of 20.6–21.4 and 24.7–25.6 GHz, respectively. A feedhorn of FIG. 3 that could produce the curves of FIGS. 5 and 6 would comprise cylinders 20, 22 and 24 have inside diameters of approximately 0.45, 0.65, and 0.82 inches, respectively, and $\theta_1=20$ degrees, $\theta_2=30$ degrees, $L_1=1.4$ inches and $L_2=2.8$ inches.

The worst discrepancy between the E and H plane patterns of FIGS. 5 and 6 can be seen to occur at 24.7 GHz, where there is shown a 10 percent difference in the $-10$ dB beamwidths, or, in other words, a discrepancy of about 2 dB at the $-10$ dB point. Such discrepancy can be caused by a relatively wide separation between the points C and E in FIG. 3 which induces a differential rotation of more than $2\pi$ for the phase vector $TM_{11}$ ($f_2$)(C) in the phase diagram of FIG. 4. Therefore, to avoid such discrepancy, the dimension CE should be such as to maintain the phase relation of FIG. 4 without going through the extra $2\pi$ differential rotation. However, the shortening of such dimension should also be understood to reduce the spacing of CD in FIG. 3, and such shortening of CD can increase the interaction between the discontinuities at points C and E since the $TM_{11}$ mode in the lower frequency band excited at C may no longer be completely suppressed by waveguide section 22 between points C and D. Such interaction may slightly increase the discrepancy between the E and H plane patterns of the lower frequency band. With an understanding of possible causes of such discrepancies that could occur, a feedhorn in accordance with the present invention can be produced having minimal discrepancies in both frequency bands of interest.

It is to be understood that the above-described embodiments are simply illustrative of the principles of the invention. Various other modifications and changes may be made by those skilled in the art which will embody the principles of the invention and fall within the spirit and scope thereof. For example, the rounded edges at points B and D are preferable but the present feedhorn also provides satisfactory performance with tapered surfaces in sections 21 and 23 of FIG. 3.

What is claimed is:

1. A dual frequency band, dual-mode feedhorn comprising:

a first waveguide section (20) comprising a longitudinal passage with a first and second port at a first and second end thereof, respectively, and capable of supporting a dominant $TE_{11}$ mode of a first and a second signal in a first and a second frequency band, respectively, propagating therein;

a second waveguide section (22) comprising a longitudinal passage, which is larger in cross-section than the longitudinal passage of the first waveguide section, with a first and a second port at a first and a second end thereof, respectively, and capable of supporting the $TE_{11}$ mode of said first and second frequency bands and only the $TM_{11}$ mode of a higher one of the two frequency bands;

a first discontinuity (21) connecting the second port of the first waveguide section with the first port of the second waveguide section and capable of converting a portion of the $TE_{11}$ mode in both frequency bands into $TM_{11}$ mode energy;

a third waveguide section (24) comprising a longitudinal passage, which is larger in cross-section than the longitudinal passage of the second waveguide section, with a first and a second port at a first and a second end thereof, respectively, and capable of supporting the $TE_{11}$ and $TM_{11}$ mode in said first and second frequency bands, said second and third waveguide sections comprising a longitudinal length such that the vector sum of the associated $TE_{11}$ and $TM_{11}$ mode components in each of the frequency bands are all substantially in phase at the second port of the third waveguide section; and a second discontinuity (23) connecting the second port of the second waveguide section with the first port of the third waveguide section and capable of converting a portion of the $TM_{11}$ mode in both frequency bands into $TM_{11}$ mode energy.

2. A dual frequency band, dual-mode feedhorn according to claim 1 wherein said first and second discontinuities comprise a first and a second tapered portion, respectively, at a respective first and second angle to an inner wall of the second and third waveguide sections, respectively.

3. A dual frequency band, dual-mode feedhorn according to claim 1 or 2 wherein said first and second discontinuities comprise a smooth rounded surface in the area where said first and second discontinuities connect to the second ports of said first and second waveguide sections, respectively, to avoid an unwanted excitation of $TM_{11}$ modes.

4. A dual frequency band, dual-mode feedhorn according to claim 1 wherein the combined longitudinal length of said second and third waveguide sections is such that a differential rotation for a phase vector for the $TM_{11}$ mode in the higher one of the two frequency bands which was excited by said first discontinuity will not exceed $2\pi$ in reaching the second port of the third waveguide section.

* * * * *